United States Patent [19]

Kaman et al.

[11] 4,348,933

[45] Sep. 14, 1982

[54] SOUNDBOARD ASSEMBLY FOR PIANOS OR THE LIKE

[75] Inventors: Charles H. Kaman, Farmington; Robert J. Mayerjak, Torrington, both of Conn.

[73] Assignee: Currier Piano Company, Inc., Marion, N.C.

[21] Appl. No.: 195,416

[22] Filed: Oct. 9, 1980

[51] Int. Cl.[3] ..... G10C 3/06

[52] U.S. Cl. ..... 84/193; 84/195; 84/212

[58] Field of Search ..... 84/291–295, 84/452 R, 192, 193, 195, 212

[56] References Cited

U.S. PATENT DOCUMENTS

| | | | |
|---|---|---|---|
| 222,287 | 12/1879 | Kreutzer . | |
| 2,428,325 | 9/1947 | Collins . | |
| 2,674,912 | 4/1954 | Petek | 84/291 |
| 3,427,915 | 2/1969 | Mooney | 84/275 |
| 3,477,330 | 11/1969 | Bert | 84/193 |
| 3,641,862 | 2/1972 | Rendell | 84/291 |
| 3,643,539 | 2/1972 | Andersen | 84/195 |
| 3,664,911 | 5/1972 | Takabayashi . | |
| 3,699,836 | 10/1972 | Glasser | 84/291 |
| 3,724,312 | 4/1973 | Yamada et al. | 84/193 |
| 3,880,040 | 4/1975 | Kaman | 84/291 |
| 4,248,124 | 2/1981 | Klaiber et al. | 84/192 |

FOREIGN PATENT DOCUMENTS

| | | |
|---|---|---|
| 591268 | 8/1941 | United Kingdom . |
| 581954 | 10/1946 | United Kingdom . |

*Primary Examiner*—Donald A. Griffin
*Assistant Examiner*—Benjamin R. Fuller
*Attorney, Agent, or Firm*—McCormick, Paulding & Huber

[57] ABSTRACT

A soundboard assembly for use in a piano, harpsicord or similar stringed musical instrument comprises a thin, laminated soundboard consisting of a center sheet of wood and two outer layers of composite material. The center wooden sheet has a substantially unidirectional grain and the two outer layers of composite material are made of unidirectional carbon fibers embedded in a resin matrix. A plurality of ribs, which may also be made as laminations of wood and layers of composite material, are secured to one face of the soundboard, and the ribs, grain of the wood, and direction of the carbon fibers are so related to one another and to the associated bridge as to produce a desirable reaction from the soundboard in response to string vibrations transmitted to it through the bridge.

16 Claims, 12 Drawing Figures

FIG. 11
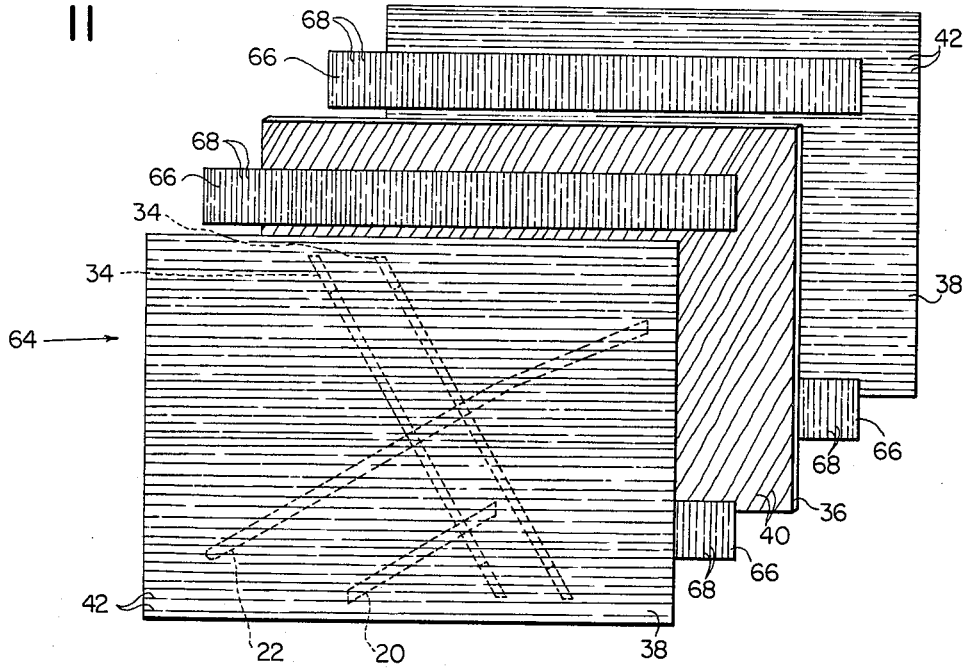
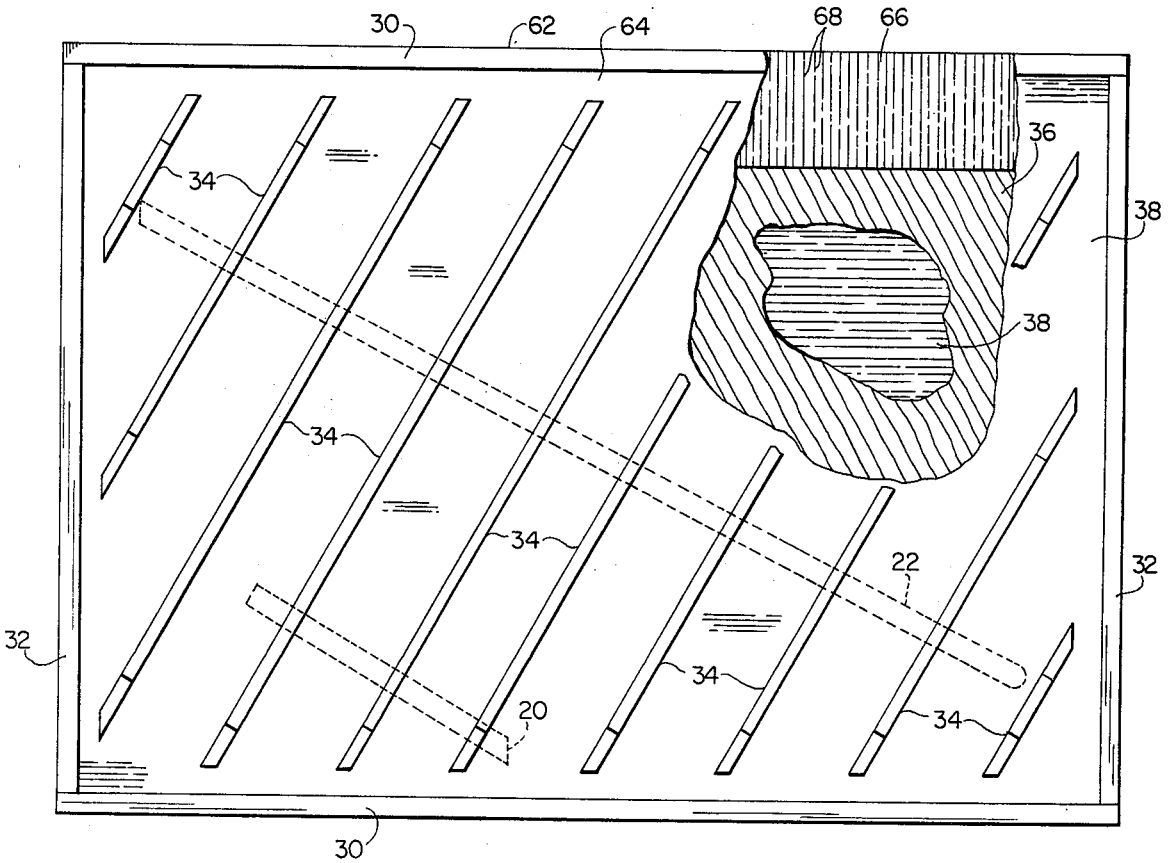
FIG. 10

SOUNDBOARD ASSEMBLY FOR PIANOS OR THE LIKE

BACKGROUND OF THE INVENTION

This invention relates to pianos and similar stringed musical instruments, and deals more particularly with an improved soundboard assembly for such instrument.

In the past it was believed by many people that the best piano soundboards were made from unlaminated sheets of wood made by gluing or otherwise joining a number of planks or boards edge-to-edge to produce a panel of sufficient size. Such unlaminated wooden soundboards are, however, expensive to make, use material which is becoming very difficult to obtain, and are subject to cracking, warping and other aging problems. To overcome these problems plywood is now often used for soundboards, and various other types of laminated structures have been proposed and used to some degree.

The general object of this invention is to provide a soundboard assembly for a piano or the like using a laminated soundboard, and which assembly is an improvement over previous assemblies using soundboards of plywood or other laminated material.

A further general object of this invention is to provide a soundboard assembly for a piano or the like which assembly has a soundboard using only a relatively small amount of wood and yet which has musical characteristics closely matching or superior to the best performing prior art soundboard assemblies.

A more detailed object of the invention is to provide a soundboard assembly of the foregoing character wherein the soundboard has a relatively small thickness in comparison to the thickness of present soundboards and yet has such modulus of elasticity, areal density, and damping characteristics as to provide the soundboard with a highly desirable frequency response.

A still further detailed object of the invention is to provide a soundboard assembly of the foregoing character including a plurality of ribs secured to the soundboard and also made of a laminated construction which allows the ribs to be made of a substantially smaller dimension than is presently customarily the case.

Other objects and advantages of the invention will be apparent from the following detailed description of a preferred embodiment and from the accompanying drawings.

Prior disclosures which are material to the invention described herein and which are known to the applicants are U.S. Pat. Nos. 222,287; 2,428,325; 2,674,912; 3,427,915; 3,477,330; 3,641,862; 3,664,911; 3,699,836; 3,724,312; and 3,880,040; and British Pat. Nos. 581,954 and 591,268.

In composite material consisting of carbon fibers embedded in a resin matrix the carbon of the fibers is sometimes of an amorphous form and sometimes of a crystalline form, and the fibers are sometimes called by different names such as "carbon fibers," "graphite fibers" or "carbon-graphite fibers" which do not consistently refer to one or the other carbon form. As used herein the term "carbon fiber" is used to refer to all types of fibers made of carbon and to include amorphic and crystalline carbon as the material from which the fibers are made.

SUMMARY OF THE INVENTION

This invention resides in a soundboard assembly for a piano or similar stringed instrument wherein such assembly comprises a soundboard consisting of a center single sheet of wood and two outer layers of composite material each bonded to a respective one of the opposite faces of the center sheet, and a plurality of generally parallel spaced ribs attached to one face of the soundboard. The wooden center sheet of the soundboard has a substantially unidirectional grain and the two outer layers of composite material are each made of unidirectional carbon fibers embedded in a resin matrix. The ribs are arranged so that when the assembly is incorporated in a piano or the like and brought into association with a bridge, the ribs cross the bridge at a substantial angle. Further, the grain of the wooden center sheet of the soundboard is oriented to cross the ribs at a substantial angle, and the unidirectional carbon fibers of the outer layers of the soundboard are arranged to cross the grain of the wood at a substantial angle. In each case the "substantial angle" involved is an angle of between 30° and 90°.

The invention also further resides in the ribs of the soundboard assembly being laminated and consisting of a body member, preferably of wood, having upper and lower edge surfaces covered at least in part by layers of composite material consisting of unidirectional carbon fibers embedded in a resin matrix.

The invention also resides in further details of construction as set forth in the claims.

BRIEF DESCRIPTION OF THE DRAWINGS

FIG. 10 is a view similar to FIG. 2 but showing a soundboard assembly comprising another embodiment of this invention.

FIG. 11 is a view in which the layers of material comprising the soundboard of FIG. 10 are shown in exploded fashion.

DESCRIPTION OF THE PREFERRED EMBODIMENT

Figure 1:
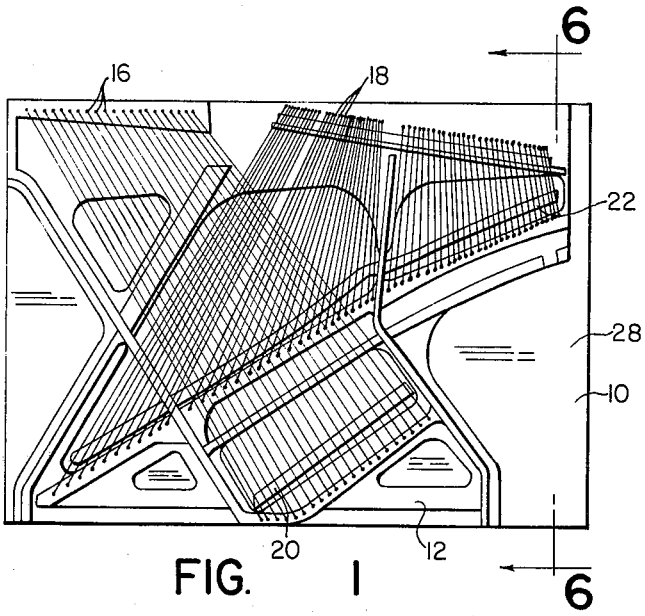
FIG. 1 is a plan view of a soundboard assembly embodying this invention, the assembly being shown in association with a string carrying plate or frame and bass and treble bridges.

Turning to the drawings, a soundboard assembly embodying this invention is shown at 10 in FIG. 1 in association with a piano plate or frame 12 carrying a set of bass strings 16, 16 and a set of treble strings 18, 18. The bass strings pass over a bass bridge 20 which engages the soundboard assembly 10 and which serves to transmit the vibrations of the bass strings to the assembly. Likewise, the treble strings pass over a treble bridge 22 which likewise engages the soundboard assembly and serves to transmit the vibrations of the treble strings to the assembly. It should be understood, however, that although the soundboard assembly 10 is shown in association with a piano plate or frame the invention is not limited to pianos but may also be used with harpiscords and other types of stringed musical instruments requiring relatively large soundboards and having a large number of strings served by one or more elongated bridges.

Figure 2:
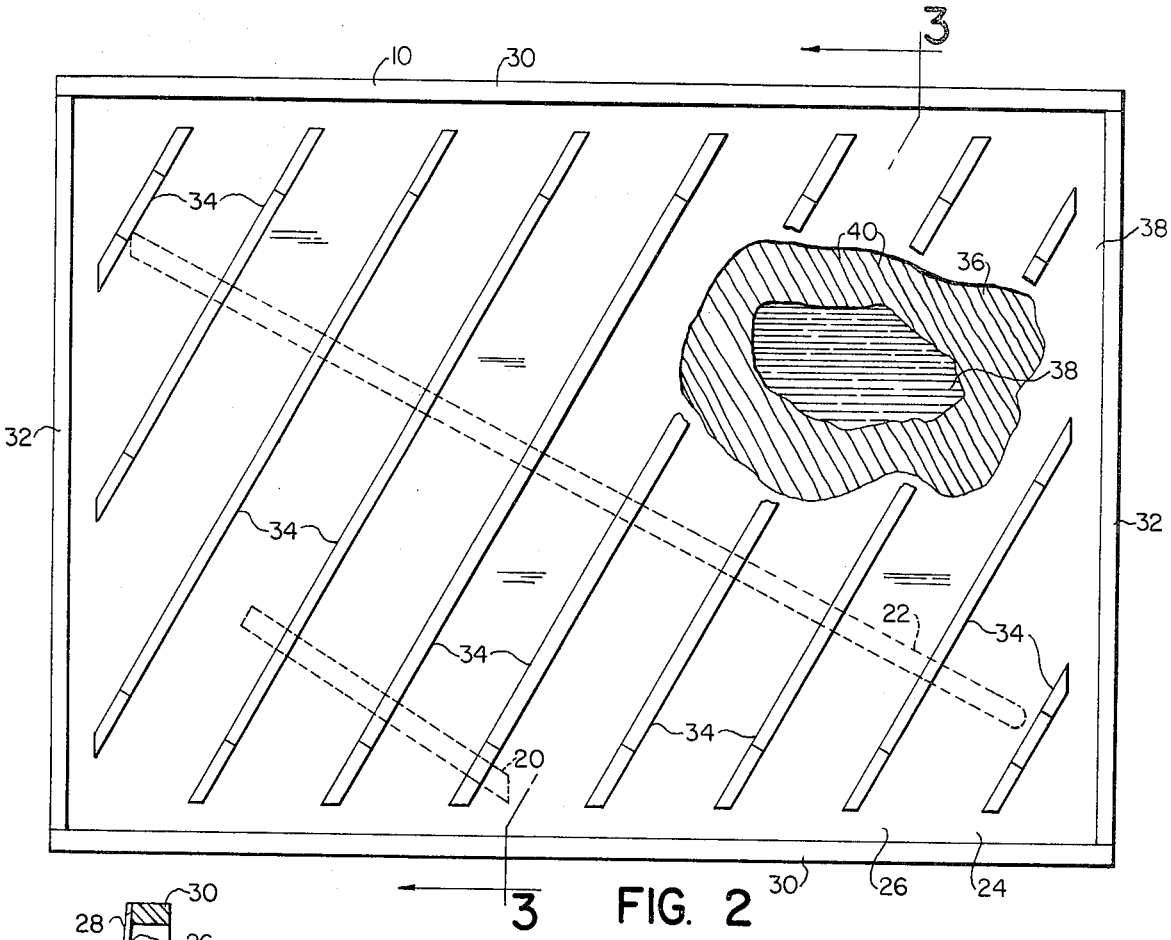
FIG. 2 is a rear view of the soundboard assembly of FIG. 1, this view being drawn on a scale enlarged from that of FIG. 1 and with part of the assembly being shown broken away to reveal details of the soundboard construction.
Figure 3:
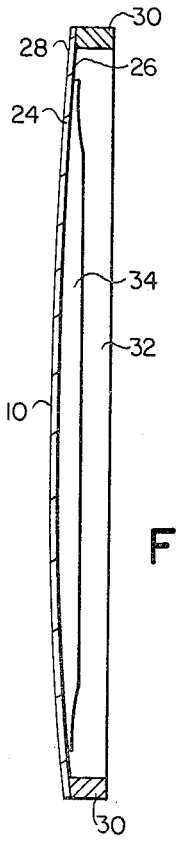
FIG. 3 is a transverse sectional view taken on the line 3—3 of FIG. 2.
Figure 4:
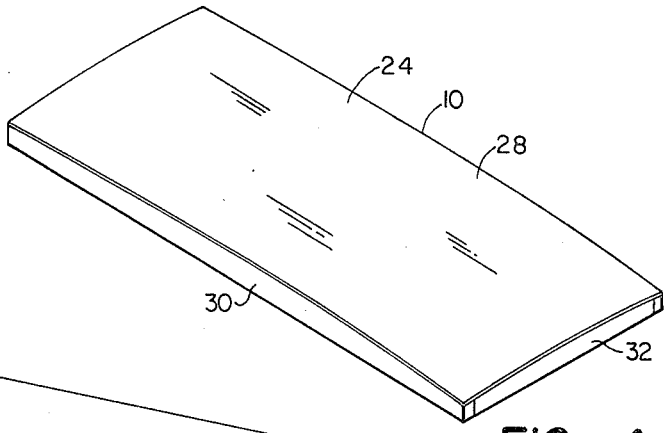
FIG. 4 is a perspective view of the soundboard assembly of FIG. 1.

As shown in FIGS. 2 to 5, the soundboard assembly 10 is comprised of a rectangular soundboard 24 having two major faces 26 and 28. Extending along the periphery of the soundboard are two horizontal edge members 30, 30 and two vertical edge members 32, 32, and secured to the rear face 26 of the soundboard, as by adhesive or resin, are a plurality of parallel spaced ribs 34, 34. Preferably, and as shown in FIGS. 3 and 4, the edge members 30, 30, 32 and 32 and the ribs 34, 34 have surfaces engaging the soundboard 24 which are slightly bowed so as to give the soundboard itself a forwardly convex curvature.

Figure 5:
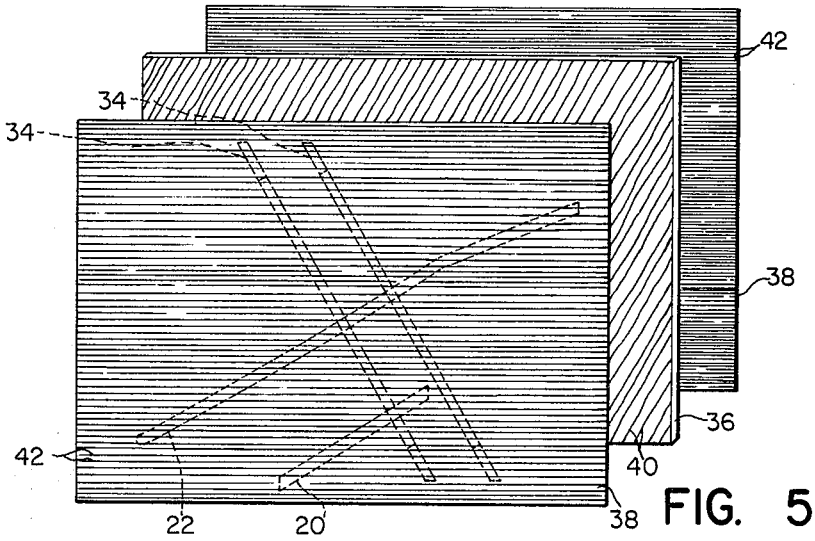
FIG. 5 is a view in which the layers of material comprising the soundboard of FIG. 1 are shown in exploded fashion.
Figure 6:
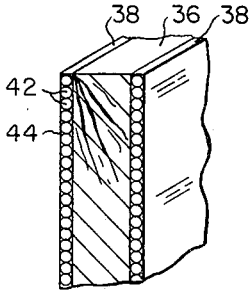
FIG. 6 is a fragmentary cross-sectional view, taken generally on the line 6—6 of FIG. 1, showing the construction of the soundboard.

In keeping with the invention the soundboard 24 is of a laminated construction which, with references to FIGS. 2, 5 and 6, consists of a center sheet 36 of wood and two outer layers 38, 38 of composite material. The center sheet 36 is made of a straight grain wood, such as Sitka spruce, and has a grain indicated at 40 in FIGS. 2 and 5 which is of substantially the same direction throughout the sheet. The sheet may be made by piecing together edge-to-edge, and end-to-end, if necessary, a number of smaller rectangular boards or panels, but through its thickness the sheet is a single piece of unlaminated wood. The two outer layers 38, 38 of the soundboard are in turn each comprised of a plurality of unidirectional carbon fibers 42, 42 embedded in a resin matrix 44. The two layers 38, 38 are bonded to the center sheet 36, preferably by the resin matrix 44, which bonding may be achieved by curing the resin matrix while the initially uncured outer layers 38, 38 are engaged with the center sheet 36.

The carbon fibers 42, 42 of the two outer layers 38, 38 of the soundboard are of very high tensile strength and, therefore, in its illustrated laminated construction the soundboard 24 may be made relatively thin while nevertheless having sufficient stiffness to resist the bending loads imposed thereon. For example, conventional plywood soundboards typically have a thickness of approximately a quarter of an inch ($\frac{1}{4}$ inch), whereas a soundboard made in accordance with this invention preferably has a thickness of approximately one-eighth inch ($\frac{1}{8}$ inch) or less. Still more particularly, in its presently preferred form, the soundboard 24 has a center sheet 36 with a thickness of approximately 0.100 inch and two outer layers 38, 38 each having a thickness of approximately 0.005 inch.

The ribs 34, 34 are relatively stiff in comparison to the soundboard and aid in transmitting the vibrations of the bridges 20 and 22 to all the regions of the soundboard. Therefore, as shown in FIGS. 2 and 5, these ribs preferably cross the bridges 20 and 22 at substantial angles. In FIG. 2 the locations of the bridges 20 and 22 are shown generally by broken lines and in FIG. 5 the locations of the bridges 20 and 22 and of the ribs 34, 34 are also shown by broken lines. Preferably the ribs are arranged approximately perpendicular to the bridges 20 and 22, but the crossing angle may vary between 30° and 90°.

The use of wood as the material for the center sheet 36 of the soundboard adds certain desirable tonal or frequency response characteristics to the soundboard which are believed to be unattainable with any other presently known materal. To bring out these desirable characteristics the grain 40 of the center sheet should be arranged at a substantial angle, between 30° and 90°, to the longitudinal axes of the ribs 34, 34. Still further, for best results, the carbon fibers 42, 42 of the two outer layers 38, 38 of the soundboard are arranged parallel to one another and at a substantial angle of between 30° and 90° to the direction of the grain 40 of the center sheet 36.

In the illustrated case the soundboard 24 is rectangular and the associated bridges 20 and 22 are arranged at approximately 30° to the board's long or horizontal edges. With this orientation of the bridges the above specified arrangement of crossing angles is achieved by arranging the ribs 32, 32 at approximately 60° angles to the board's long edges (and approximately perpendicular to the bridges), by arranging the grain of the wood at approximately a 60° angle to the board's long edges and by arranging the carbon fibers 42, 42 parallel to the board's long edges. Without making other changes the grain 40 of the wooden center sheet could be oriented to run vertically without departing from the invention. Or, without making other changes, the carbon fibers 42, 42 could be oriented to run vertically without departing from the invention; and many other specific orientations of the ribs, wood grain and carbon fibers may be employed within the compass of the invention.

Figure 7:
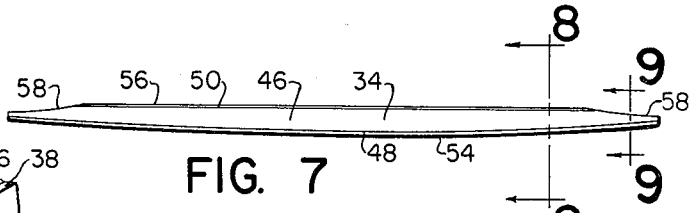
FIG. 7 is a side elevational view of one of the ribs of the soundboard assembly of FIG. 1.
Figure 8:
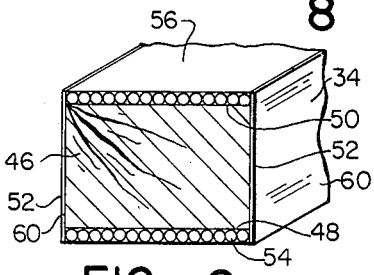
FIG. 8 is a cross-sectional view taken on the line 8—8 of FIG. 7.
Figure 9:
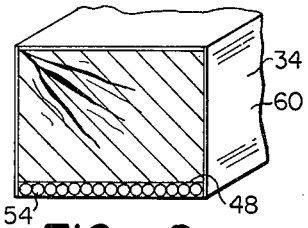
FIG. 9 is a cross-sectional view taken on the line 9—9 of FIG. 7.

The ribs 34, 34 are also of laminated construction. As shown in FIGS. 7, 8 and 9 each rib 34 is comprised of an elongated body member 46, preferably made of Sitka spruce or other relatively straight grained wood, having a lower edge surface 48, an upper edge surface 50 and two side surfaces 52, 52 extending between the lower and upper edge surfaces 48 and 50. The lower edge surface 48 is covered throughout substantially its entire length by a layer 54 of composite material similar to that of the soundboard layers 38, 38 and consisting of a plurality of unidirectional carbon fibers, oriented parallel to the longitudinal axis of the rib, embedded in a resin matrix. The upper edge surface 50 has an intermediate portion which is covered by another layer 56 of composite material, similar to that of the layer 54. At either end of the rib the upper edge surface has a terminal portion 58, 58 which is free of any composite material. Furthermore, the rib body has a dimension perpendicular to the soundboard which gradually decreases in going from one end of the intermediate portion of the upper edge surface to the adjacent end of the rib. Therefore, the rib 34, as illustrated in FIG. 7, has a relatively high stiffness throughout the length of the upper composite layer 56 and is more flexible along the terminal surface portions 58, 58. This gives the soundboard 24 somewhat of a "drum head" effect by reducing the combined stiffness of the soundboard and ribs in the vicinity of the peripheral members 30, 30, 32 and 32.

The side surfaces of each rib and the terminal portions 58, 58 are covered with a sealing material 60 to inhibit the migration of moisture into or out of the rib body and preferably this sealing material is the same resin as used to provide the matrix of the upper and lower layers 54, 56 of composite material.

FIG. 10 shows another soundboard assembly 62 embodying this invention. This assembly is identical to the soundboard assembly 10 except for having a soundboard 64 of slightly different construction from the soundboard 24. Therefore, in FIGS. 10 and 11 parts which are the same as corresponding parts of the soundboard assembly 24 of FIGS. 1 to 9 have been given the same reference numbers as in those figures and need not be redescribed.

Referring both to FIGS. 10 and 11 the soundboard 64 of the assembly 62 is the same as the soundboard 24 except for additionally including four doubler strips 66, 66 of composite material. Two of these doubler strips are located along the top edge of the soundboard and the other two along the bottom edge. Each doubler strip 66 is preferably made of the same composite material as the two outer layers 38, 38 and more particularly preferably are comprised of a plurality of unidirectional carbon fibers 68, 68 embedded in a resin matrix and oriented generally perpendicularly to the fibers 42, 42 of the layers 38, 38. As illustrated by the one doubler strip 66 shown in FIG. 10, each such strip is of such width as to extend from its associated edge of the soundboard inwardly by a sufficient amount as to overlap to some extent the adjacent ends of the ribs 34, 34. Therefore, the doubler strips 66, 66 are located in the transition regions between the longitudinal edges of the soundboard and the ribs. In these transition regions the support for the lateral loads produced by the strings shifts from the ribs to the soundboard. The doublers give the soundboard additional strength in the transition regions to handle the string loads without substantially effecting the frequency response or other musical characteristics of the soundboard.

In FIG. 11 each doubler strip 68 is shown to be located between one of the outer layers 38 and the center wooden sheet 36. This arrangement has the virtue of concealing the doubler strips from view, but the arrangement is not critical and, if desired, the doubler strips may be placed on the outside of their associated layers 38, 38. Also, in cases where doubler strips are used to add additional strength to the transition regions of the soundboard, it may be sufficient to use only a single such strip along each longitudinal edge of the soundboard rather than the two such strips for each edge as illustrated in FIG. 11.

Figure 12:
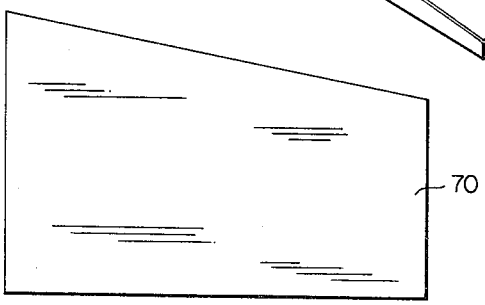
FIG. 12 is a plan view showing a soundboard of alternate shape which may be used in a soundboard assembly embodying this invention in place of the rectangular soundboards of FIGS. 2 and 10.

It should also be noted that in the previously described soundboard assemblies the soundboards 24 and 64 have been illustrated as being of rectangular shape. Such rectangular shape is not, however, important to the broader aspects of the invention and the invention may be applied to soundboard assemblies having soundboards of various different shapes other than rectangular. Among the many other shapes which may be employed a sometimes preferred one is a trapezoidal shape such as illustrated by the soundboard 70 shown in FIG. 12, and therefore it should be specifically understood that the invention may be applied to a soundboard assembly having a soundboard shaped as the illustrated soundboard 70 and otherwise constructed in accordance with the invention similar to the soundboards 24 or 64.

We claim:

1. In a piano or similar stringed instrument, the combination comprising: a soundboard assembly with two major parallel soundboard faces, and an elongated bridge which engages one of said soundboard faces of said assembly to transmit vibrations of associated strings thereto, said soundboard assembly comprising a soundboard consisting of a center single sheet of wood, and two outer layers of composite material each bonded to a respective one of the opposite faces of said center sheet and each providing a respective one of said soundboard faces, and a plurality of generally parallel spaced ribs secured to said soundboard in engagement with said face thereof opposite said face engaged by said bridge, said ribs being arranged at an angle of between 30° and 90° to said bridge, said center sheet of wood of said soundboard having a grain with a generally uniform direction throughout said sheet and which grain directions is arranged at an angle of between 30° and 90° to said ribs, and each of said two outer layers of composite material consisting substantially solely of a plurality of unidirectional carbon fibers embedded in a resin matrix and which carbon fibers are oriented at an angle of between 30° and 90° to said grain direction of said center sheet of wood.

2. The combination defined in claim 1 further characterized by said carbon fibers of one of said outer layers of composite material being generally parallel to said carbon fibers of the other of said outer layers of composite material.

3. The combination defined in claim 1 further characterized by said soundboard being rectangular in shape, and by said carbon fibers of each of said outer layers of composite material being arranged parallel to one of the edges of said soundboard.

4. The combination defined in claim 1 further characterized by said soundboard having a total thickness of approximately $\frac{1}{8}$ (one-eighth) inch or less.

5. The combination defined in claim 1 further characterized by said center sheet of wood having a thickness of approximately 0.100 inch, and each of said outer layers of composite material having a thickness of approximately 0.005 inch.

6. The combination defined in claim 1 further characterized by each of said ribs being comprised of an elongated body member having a lower edge surface adjacent and parallel to said soundboard and an upper edge surface spaced from said lower edge surface, said body member also having two opposite side surfaces arranged generally perpendicular to said soundboard and extending between said lower and upper edge surfaces, a layer of composite material extending along and covering the major portion of the length of said lower edge surface, and a layer of composite material extending along and covering a portion of said upper edge surface, each of said layers of composite material forming part of said rib consisting of a plurality of unidirectional carbon fibers embedded in a resin matrix and oriented generally parallel to the longitudinal axis of the rib.

7. The combination defined in claim 6 further characterized by said upper edge surface of the body member of each of said ribs including an intermediate portion extending less than fully between the ends of said rib and two terminal portions each extending from a respective one of the ends of said intermediate portion to the adjacent end of said rib, said layer of composite material associated with said upper edge surface of said rib body member extending along substantially the entire length of said intermediate portion of said upper edge surface, and said layer of composite material associated with said lower edge surface extendng along substantially the entire length of said lower edge surface, said terminal edge portions of said upper edge surface being free of any covering of composite material.

8. The combination defined in claim 7 wherein said rib body member is of gradually decreasing dimension as measured perpendicular to said soundboard in going from each end of said intermediate portion of said upper surface to the adjacent end of said rib.

9. The combination defined in claim 7 further characterized by said side surfaces and said terminal portions of said upper edge surface of each rib body member being covered with a sealing material.

10. The combination defined in claim 9 further characterized by said sealing material being the same material as the matrix portion of the layers of composite material associated with said lower and upper edges of said rib body member.

11. The combination defined in claim 6 further characterized by said body member of each of said ribs being made of wood.

12. The combination defined in claim 1 further characterized by said soundboard being trapezoidal in shape.

13. The combination defined in claim 1 further characterized by said soundboard having upper and lower longitudinal edges, said ribs having ends which terminate short of said upper and lower soundboard edges, a first doubler strip of composite material extending along said upper soundboard edge, and a second doubler strip of composite material extending along said lower soundboard edge, each of said doubler strips extending from its associated longitudinal edge of said soundboard toward the adjacent ends of said ribs.

14. The combination defined in claim 13 further characterized by each of said doubler strips extending inwardly from its associated longitudinal edge of said soundboard into partially overlapping relationship with the adjacent ends of said ribs.

15. The combination defined by claim 13 or claim 14 further characterized by each of said doubler strips being made of carbon fibers embedded in a resin matrix and having its fibers oriented generally perpendicularly to said carbon fibers of said two outer layers.

16. The combination defined in claim 3 further characterized by said grain of said center sheet of wood being arranged so as to be at an angle of approximately 60° to one of the edges of said soundboard.

* * * * *